US005685024A

United States Patent [19]

Chu et al.

[11] Patent Number: 5,685,024

[45] Date of Patent: Nov. 11, 1997

[54] MECHANISM FOR AUTOMATICALLY CHANGING CLOSESTOOL SEAT SANITARY COVER

[76] Inventors: Henry Chu, No. 12, Lane 556, Chung Cheng Road, Shu Lin Chen, Taipei Hsien; Sun-Mao Hu, No. 222-4, Chung Shan West Street, Lo Tung Chen, Yi Lan Hsien, both of Taiwan

[21] Appl. No.: 643,874

[22] Filed: May 7, 1996

[51] Int. Cl.[6] ..... A47K 13/20

[52] U.S. Cl. ..... 4/243.2

[58] Field of Search ..... 4/243.1, 243.2

[56] References Cited

U.S. PATENT DOCUMENTS 4,213,212 7/1980 Hefty et al. ..... 4/243.2

5,253,372 10/1993 Boker ..... 4/243.2

*Primary Examiner*—Robert M. Fetsuga

*Attorney, Agent, or Firm*—Morton J. Rosenberg; David I. Klein

[57] ABSTRACT

Disclosed is a mechanism for automatically changing closestool seat sanitary cover mainly includes a roll-up mechanism and a specially designed closestool seat. The roll-up mechanism includes a supply reel on which continuous sleeve-like sanitary cover is wound, an upper and a lower reels for pulling used sanitary cover away from the closestool seat, and a motor for rotating the upper and the lower reels in opposite directions. The closestool seat is substantially a C-shaped member having two end portions separately pointing to the supply reel and to the upper and the lower reels. A transverse beam laterally extends from near one end portion of the seat pointing to the upper and the lower reels and has short rods downward project from a bottom side thereof with springs put around them, such that the seat is normally slightly lifted away from the closestool by the springs, allowing the sleeve-like sanitary cover to be pulled from the supply reel to wrap around the end portion of the seat pointing to the supply reel. The sanitary cover can be then pulled along the seat toward the other end portion and be clamped between the upper and the lower reels. When the motor is started up, the upper and the lower reels are rotated in opposite directions to pull the used part of the sanitary cover to move backward so that new and clean sanitary cover can be pulled from the supply reel to wrap the seat for the next use.

1 Claim, 3 Drawing Sheets

MECHANISM FOR AUTOMATICALLY CHANGING CLOSESTOOL SEAT SANITARY COVER

BACKGROUND OF THE INVENTION

In most of the present public restrooms, an individual paper pad is spread over the closestool seat for use as a sanitary means. Such paper pad is not convenient in use and is usually not easily fixedly positioned over the closestool seat. It is therefore desirable to develop a closestool seat sanitary cover which may eliminate the shortcoming existed in the conventional paper pad.

SUMMARY OF THE INVENTION

A primary object of the present invention is to provide a mechanism which automatically provides continuous sanitary cover for wrapping around the closestool seat. The used part of sanitary cover can be automatically rolled up so that new and clean sanitary cover is subsequently provided to the closestool seat. The sanitary cover can be made of any material which is wear-resistant, degradable, and comfortable in use.

DETAILED DESCRIPTION OF THE PREFERRED EMBODIMENTS

Figure 1:
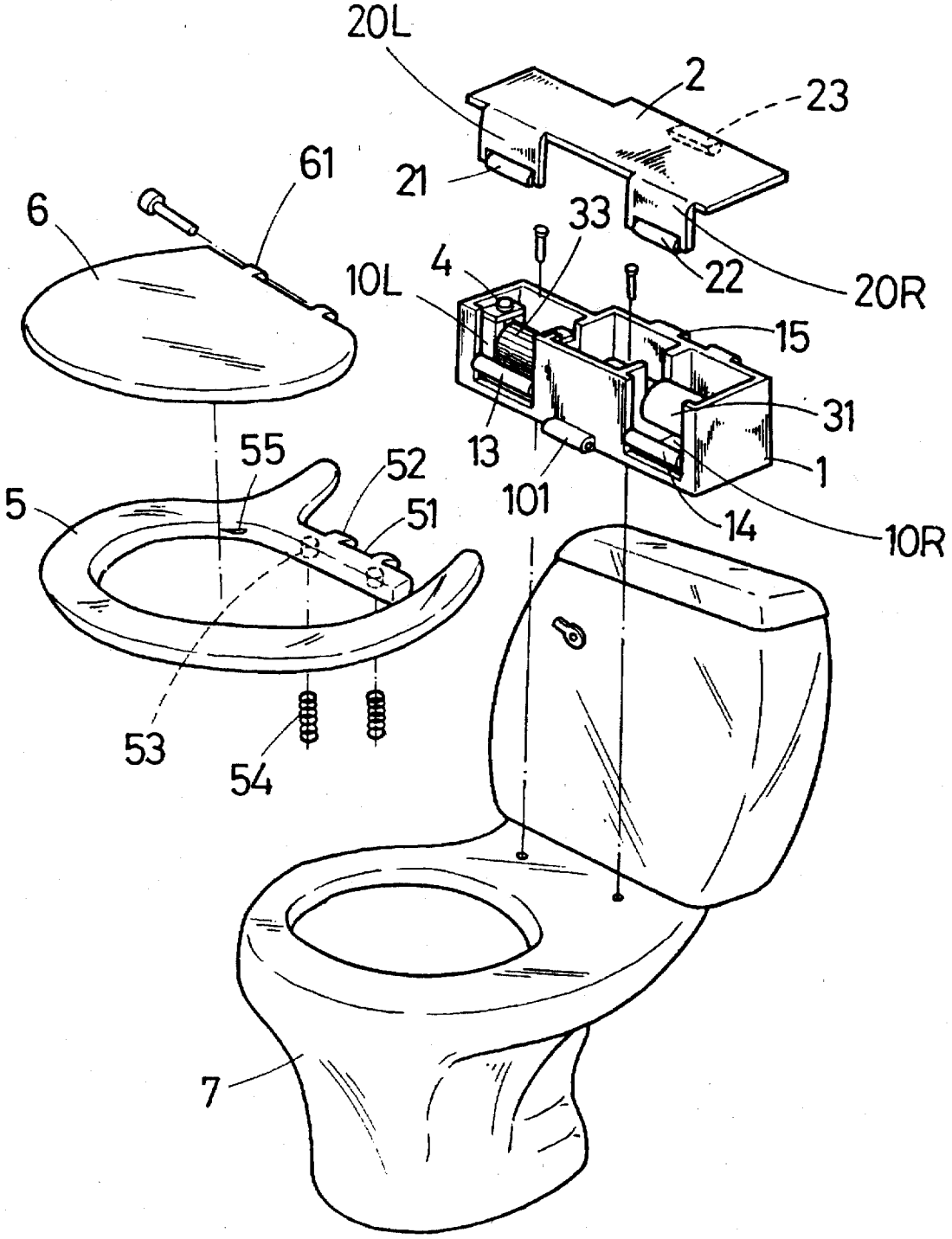
FIG. 1 is a disassembled perspective of the present invention.

Please refer to the figures, the present invention relates to a mechanism for automatically changing closestool seat sanitary cover and mainly includes a box 1 removably mounted onto a closestool 7 by screws threading through a bottom of the box 1, a top cover 2 pivotally connected to a top of the box 1, a roll-up mechanism and an adjustment mechanism 4 both accommodated in the box 1, and a closestool seat 5 pivotally connected to a front side of the box 1.

An inner space of the box 1 is divided into three chambers 1L, 1M, and 1R from left to right by a left and a right partitions 11, 12 (when viewing in front of the box 1). Openings 10L, 10R are formed at a front surface of the chambers 1L, 1R, respectively. Holes are provided at two side walls of openings 10L, 10R for two lower cylindrical shafts 13, 14 to extend across the openings 10L, 10R, respectively, and be fixed thereto. A pair of spaced lugs 15 each having a through hole extending a full length thereof project from a rear upper edge of the box 1, and a fixing sleeve 101 also having a through hole extending a full length thereof projects from a front lower edge of the box 1. A U-shaped support 19 is provided to a rightside inner wall of the box 1 corresponding to a dent 121 formed on the right partition 12. Two vertically extended small compartments 17, 18 having a rectangular cross-section are provided in the chamber 1L to attach to a leftside inner wall of the box 1 and to a left side of the left partion 11, respectively. Both the compartments 17, 18 have a threaded hole formed on their respective top surface. And, a back opening 16 is formed at a rear wall of the chamber 1L, and a dent 111 is formed on the left partition 11 generally corresponding to the dent 121 on the right partition 12.

The top cover 2 has a lug 23, too, which is provided to a bottom surface of the cover 2 at a rear edge thereof and has a through hole extending a full length thereof. The top cover 2 can be pivotally connected to the box 1 by threading a bolt (not shown) through the pair of lugs 15 on the box 1 and the lug 23 on the top cover 2. Two spaced panels 20L, 20R downward extend from a front edge of the top cover 2 corresponding to the openings 10L, 10R of the box 1, respectively. A shallow dent is formed on each panel 20L, 20R at a lower edge thereof with holes provided at two side walls of each of these dents, such that two upper cylindrical shafts 21, 22 can separately extend across the dents and be fixed thereto. When the top cover 2 is closed onto the box 1, the panels 20L, 20R just locate within the openings 10L, 10R, respectively, with a clearance left between each pair of the upper and the lower cylindrical shafts 21, 13 and 22, 14.

The roll-up mechanism includes a supply reel 31, a lower reel 32, an upper reel 33, and a motor 34. The supply reel 31 is supported in the chamber 1R by disposing two ends of a central shaft thereof on the dent 121 and the U-shaped support 19 and has new and clean sanitary cover in continuous sleeve form wound therearound. Both the lower and the upper reels 32, 33 have axially parallel fine ribs on their circumferential surface to extend across a full lenth of the reels. The reels 32, 33 each also has a central shaft, two ends of which extend into the two small compartments 17, 18 with a bearing 35 attached thereto, such that they are vertically sequentially supported in the chamber 1L between two compartments 17, 18 with a clearance left between them. The motor 34 is fixed in the chamber 1M of the box 1 by screws and is connected to a control means (not shown) for controlling the operation of the motor 34. The motor 34 has a shaft, on a free end of which a gear 341 is mounted to engage with a gear 321 mounted to one end of the central shaft of the lower reel extending through the compartment 18 and the partition 11 into the chamber 1M.

The adjustment mechanism 4 includes two identical sets which separately disposed in the compartments 17, 18. Each set of the adjustment mechanism 4 includes a threaded stem 43 which has a disc member connected to a bottom end thereof. The stem 43 upward extends through a press plate 42 disposed in the compartment 17 or 18 with the disc member fitly received in and stopped by a bottom recess of the press plate 42. The stem 43 further sequentially extends through a spring 44 and a locating plate 41 with its top end engaging into a hole formed on a bottom surface of an adjusting knob 45 above the locating plate 41. The stem 43 is engaged into a threaded hole of the locating plate.

The closestool seat 5 is substantially a C-shaped member with two free end portions thereof slightly inclining upward. A transverse beam 51 extends from near one free end portion of the seat 5 toward but not contacting the other end portion of the seat 5. Two lugs 52 project from a rear edge of the beam 51 and two short rods 53 project downward from a bottom surface of the beam 51 to fixedly receive two springs 54 therearound. Furthermore, a slot is provided to an inner periphery the seat 5 near a joint of the beam 51 and the seat 5 for receiving a cutting means 55, such as a razor, therein.

Figure 2:
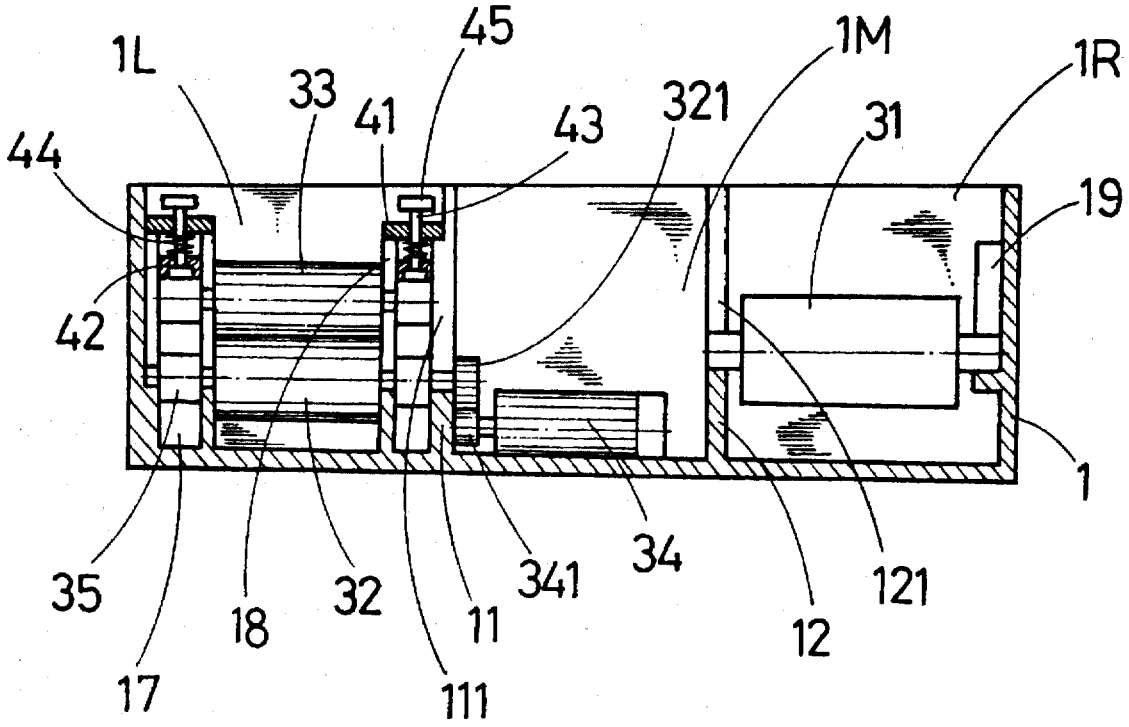
FIG. 2 is a sectional view showing the sanitary cover roll-up mechanism of the present invention.
Figure 3:
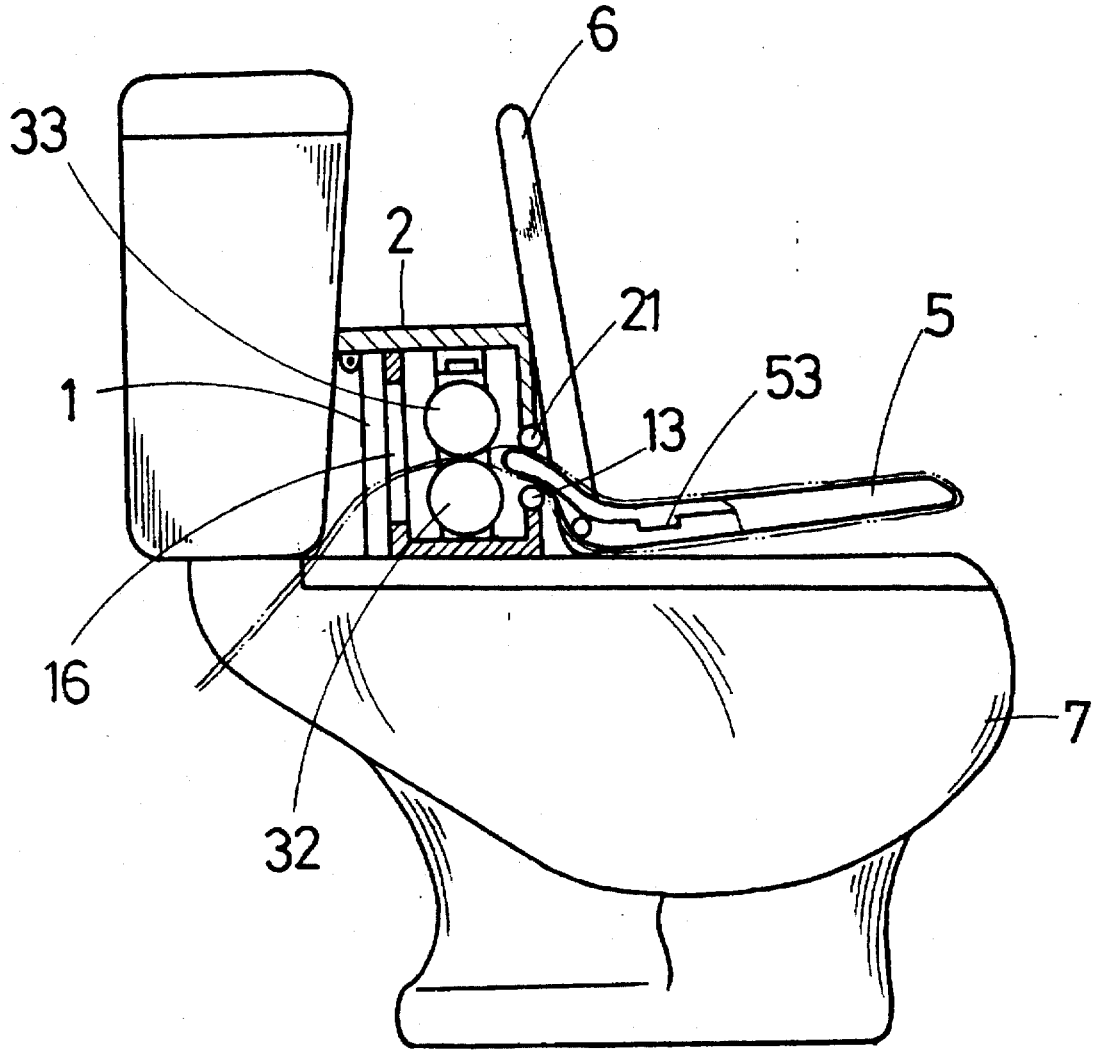
FIG. 3 illustrates the manner in which the sanitary cover is wrapped around the closestool seat and passed through the roll-up mechanism.

Please particularly refer to FIGS. 2 and 3, the seat 5 and a closestool cover 6 having two lugs 61 at a rear edge thereof are pivotally connected to the box 1 by threading a bolt through the lugs 61, 52, and the fixing sleeve 101 on the box 1 so that the cover 6 and the seat 5 can be lifted toward the box 1 which has been fixedly screwed to the closestool 7. The two slightly upward inclined end portions of the fixed seat 5 shall, after the seat 5 is fixed to the box 1 and is in a lying down position on the closestool 7, separately extend into the clearances between the cylindrical shaft pairs 21, 13 and 22, 14. And, due to the two springs 54 fixed to and around the two short rods 53 below the beam 51, the seat 5 is slightly lifted without contacting its bottom surface with the closestool 7.

The new, clean and continuous sleeve-like sanitary cover wound on the supply reel 31 disposed in the chamber 1R of the box 1 can be pulled outward to wrap around the end portion of the seat 5 extending into and between the cylindrical shafts 22, 14, and then, be further pulled along the C-shaped seat 5 toward the other end portion thereof. The sanitary cover is cut open at one inner side by the razor 55 when it passes the razor 55, so that the sanitary cover is allowed to pass the beam 51 and to proceed to the other end portion of the seat 5 and finally extends into and between the cylindrical shafts 21, 13 and then, the lower and the upper reels 32, 33. With the ribs on the circumferential surfaces of the reels 32, 33, the sanitary cover passing between the reels 32, 33 can be movably clamped there between before it is sent out of the back opening 16 on the box 1.

When the seat 5 covered with the sanitary cover has been used and the user has left the seat 5 allowing the same to be slightly lifted by the springs 54, the control means for the motor 34 can be turned on to start up the motor 34, that is, the gear 341 is rotated and causes the gear 321 to rotate, too. The rotating gear 321 shall further cause the lower and the upper reels 32, 33 to rotate in opposite directions and thereby, together pull the used sanitary cover backward to extend out of the box 1 via the back opening 16. Meanwhile, the new and clean sanitary cover wound on the supply reel 31 is pulled to move forward and wraps the whole seat 5 so that the same is ready for use again.

To permit an adequate clearance between the lower and the upper reels 32, 33 so that the sanitary cover can be conveniently and properly pulled backward by the two reels 32, 33, the adjusting knob 45 of the adjustment mechanism 4 can be rotated to move the threaded stem 43 upward or downward, so that the springs 44 put around the stem 43 may press or release the press plates 42 against or from the bearings 35 mounted at two ends of the shaft of the upper reel 33 to reduce or increase the clearance between the reel 33 and the reel 32.

What is claimed is:

1. A closestool seat and mechanism for automatically changing a sanitary cover, comprising:

a box defining an inner space which is divided into a left, a middle and a right chamber by a left and a right partition, said box having a U-shaped support attached to a rightside inner wall in the right chamber corresponding to a dent formed on said right partition and two small compartments which have a rectangular cross section and are separately attached to two sides of said left chamber, said left and said right chambers each having a front opening and a cylindrical shaft to extend across and be fixed thereto, and a fixing sleeve being provided to a front side of said box between said two front openings;

a top cover being pivotally connected to said box to close the same and having two front panels extending downward into said two front openings of said box, each of said front panels having a cylindrical shaft attached to a lower recess formed at a lower edge thereof to correspond to each said cylindrical shaft fixed to said front openings of said box;

a roll-up mechanism comprising a supply reel disposed in said right chamber for winding the sanitary cover thereon, a lower reel and an upper reel disposed in said left chamber, and a motor disposed in said middle chamber; said lower and said upper reels having axially and parallelly extended fine ribs on their circumferential surface, said lower reel having a first gear connected to a central shaft thereof to engage with a second gear connected to a rotating shaft of said motor;

two sets of adjustment mechanisms separately disposed in said two small compartments in said box for adjusting a clearance between said lower and said upper reels, each set of said adjustment mechanism further comprising a press plate, a threaded stem upward extending through said press plate, a spring around said threaded stem, a locating plate being extended through by said threaded stem, and an adjusting knob attached to a top end of said threaded stem extending out of said locating plate; and a closestool seat being a substantially C-shaped member and having two end portions slightly inclining upward to separately point to said supply reel in said right chamber and said lower and said upper reels in said left chamber and a transverse beam laterally extending from near one of said end portions pointing to said left chamber toward but not contacting the other said end portion pointing said right chamber; short rods being provided to a bottom side of said transverse beam to each fixedly receive a spring therearound to slightly lift said seat when mounted to a closestool, and cutting means being provided to an inner periphery of said seat near a joint of said beam with said end portion from where said beam extends;

whereby said sleeve-like sanitary cover wound on said supply reel can be pulled from said supply reel to wrap around one of said upward inclining end portions of said closestool seat and be pulled along said C-shaped seat toward the other said end portion, and be cut open at an inner side when it passes said cutting means to allow it to extend over said beam and thread through said clearance between said lower and said upper reels, and, when said motor is started up to rotate said second gear which meshes with said first gear connected to said lower reel, said lower and said upper reels are brought to rotate in opposite directions and thereby together pull a used part of said sanitary cover around said seat to extend between them and be sent out of said box while another clean part of said clean sanitary cover is pulled from said supply reel to wrap around said seat for the next use.

* * * * *